United States Patent [19]

Thomas

[11] Patent Number: 4,739,961

[45] Date of Patent: Apr. 26, 1988

[54] HOLDER FOR PLATE

[76] Inventor: James E. Thomas, 16 W 67 Timberview Dr., Oak Brook, Ill. 60521

[21] Appl. No.: 90,818

[22] Filed: Aug. 28, 1987

[51] Int. Cl.[4] ..... A47G 1/16

[52] U.S. Cl. ..... 248/490; 211/41; 248/359 I; 248/359 R

[58] Field of Search ..... 248/490, 488, 359 F, 248/359 G, 359 R, 359.1, 359, 491; 211/41

[56] References Cited

U.S. PATENT DOCUMENTS

| | | | |
|---|---|---|---|
| 2,315,268 | 3/1943 | Oliphant | 248/490 |
| 3,219,182 | 11/1965 | Cornwell, Jr. | 211/41 X |
| 4,223,864 | 9/1980 | Harlow | 248/490 |

FOREIGN PATENT DOCUMENTS

| | | | |
|---|---|---|---|
| 958245 | 1/1957 | Fed. Rep. of Germany | 248/488 |
| 168468 | 9/1959 | Sweden | 248/490 |
| 28200 | of 1908 | United Kingdom | 248/488 |
| 473080 | 10/1937 | United Kingdom | 248/491 |

*Primary Examiner*—David L. Talbott

[57] ABSTRACT

A device for supporting and displaying a decorative article such as a plate or plaque. The device comprises a pair of similar flat base members, for attachment to upper and lower edge portions of the supported article, and an uninterrupted elastic band extending around portions of the base members to draw them toward each other for snug engagement with the supported article.

1 Claim, 1 Drawing Sheet

HOLDER FOR PLATE

BACKGROUND OF THE INVENTION

1. Field of the Invention

This invention relates generally to display devices, and more particularly to a device for holding and displaying a decorative article, such as a plate or a plaque, from a vertical surface, such as a wall.

2. Description of the Background Art

A search directed to the subject matter of this application was conducted in the U.S. Patent Office and disclosed the following U.S. Pat Nos.: 213,264; 806,321; 1,022,090; 2,315,268; 2,365,108; 2,632,971; 3,001,748; 3,074,860; 3,740,016.

None of the patents uncovered in the search discloses a holding device comprising a pair of generally flat base members having integral hooks projecting therefrom for engaging plate edges and having other hook-like elements extending therefrom for engaging an elastic band which is operative to draw the two base members together, so they snugly engage the article which is held and supported.

SUMMARY OF THE INVENTION

It is an object of the present invention to provide a holding device for displaying a decorative article, such as a plate or a plaque, from a vertical surface, such as a wall.

Another object of the invention is the provision, of a plate holding device that comprises a pair of base members adapted to grip opposite sides of a plate, and an elastic band extending around portions of the base members and operative to draw the members together, so that the plate will be snugly engaged by them.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
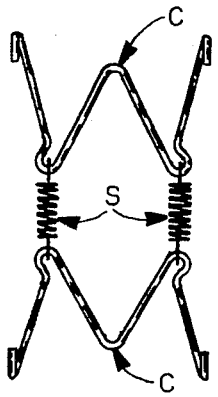
FIG. 1 (PRIOR ART)
FIG. 1 is a fragmentary side elevational view of a typical prior art plate holding device that is currently available in the marketplace.

In FIG. 1 there is illustrated a common type of plate holding device of the type that is currently available. This type of device comprises a pair of wire clips attached to each other by a pair of coil springs and having hooks for engaging opposite edges of a plate.

Figure 2:
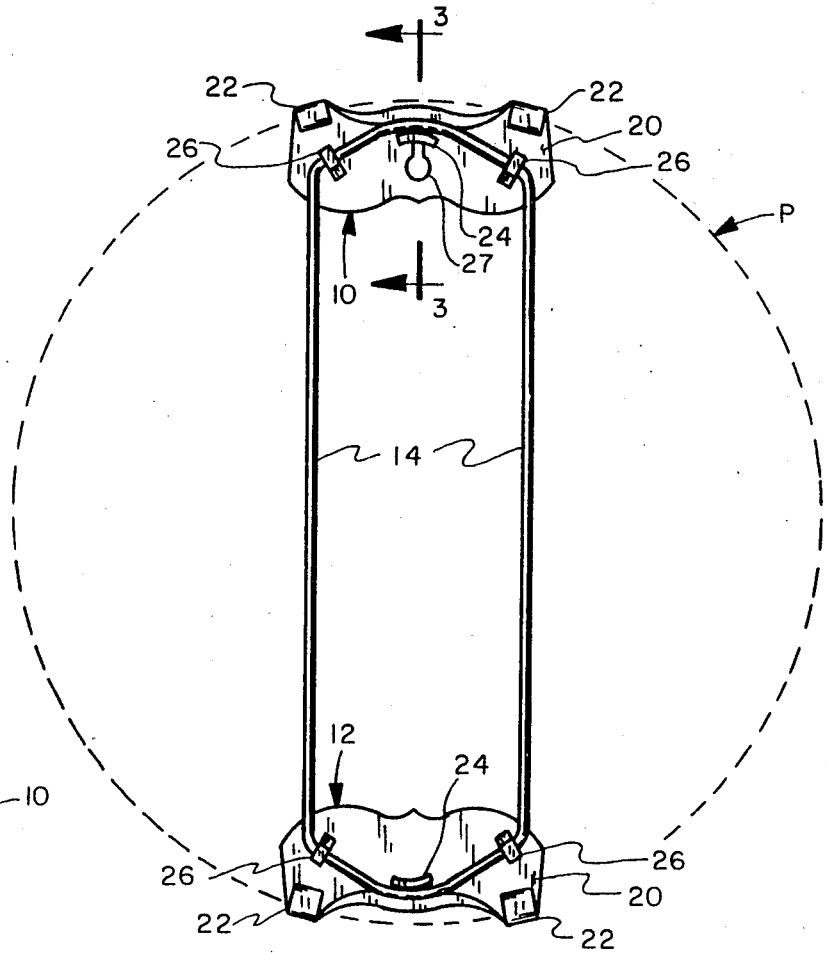
FIG. 2 is a fragmentary side elevational view of a holding device embodying features of the present invention, as shown attached to a decorative article such as a plate.

The present invention is believed to constitute a definite improvement over the prior art and is best illustrated in FIG. 2 of the drawings.

As seen in FIG. 2, the novel plate holding device embodying features of the present invention includes a pair of generally similar, although not necessarily identical, top and bottom brackets indicated generally at 10 and 12, respectively. The brackets are adapted to engage upper and lower edges of a decorative article such as a plate P and are secured to each other by a single uninterrupted elestic band 14.

If desired for use with certain extremely large plates, additional side clips 16, which are discussed later in the specification, may be used.

Figure 3:
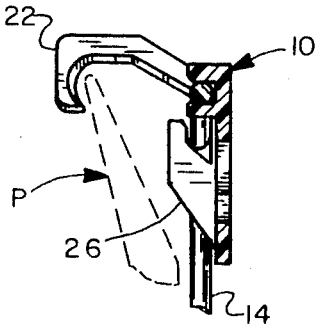
FIG. 3 is a fragmentary, vertical sectional view taken on line 3—3 of FIG. 1.

Referring to FIGS. 2 and 3, it will be seen that top and bottom brackets 10 and 12 are preferably formed from molded plastic material, and each includes a relatively thin flat base or plate-like member 20, having a pair of integral arms 22 projecting therefrom adjacent the outer edge thereof for engagement with an edge portion or rim of a plate P.

Each base members 20 also has formed integrally therewith and projecting therefrom a second pair of arms or hook-like elements 26 which are positioned slightly inwardly from the first mentioned arms 22 and which are adapted to engage and retain portions of a continuous, uninterrupted, elastic band 14.

The purpose of the band 14 is to draw the upper and lower brackets together, so they will snugly engage the plate P. For additional support the brackets may also be provided with a projecting shelf or ledge 24 which, in cooperation with the elements 26, serves to hold the elastic band and keep it in place attached to the related bracket.

In order to support the device and the plate from the wall, upper bracket 10 may be provided with a keyhole-type aperture 27 extending therethrough to allow the bracket to be supported by a nail projecting from a wall.

The elastic band 14 may be formed of any material, but it is preferably formed of a resilient thermoplastic material that is molded or extruded.

Figure 4:
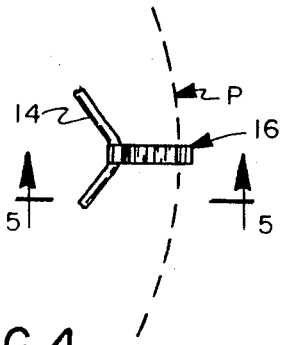
FIG. 4 is a fragmentary side elevational view similar to that of FIG. 2, but illustrating a slightly modified form of the invention.

Now referring to FIG. 4, it wwill be seen that a slightly modified form of the invention is shown.

In situations where the decorative article to be supported is extremely wide or has an irregular shape, it may be necessary to use supplemental holding elements in addition to the previously described brackets.

Figure 5:
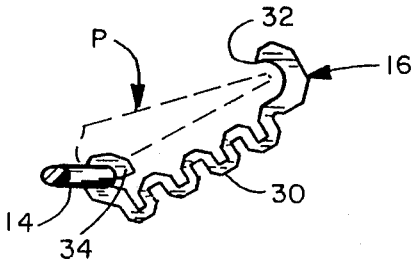
FIG. 5 is a fragmentary horizontal sectional view taken on line 5—5 of FIG. 4.

For a wide plate there may be provided, at each side of the plate, (only one side being shown in the drawing) a clip 16. As best seen in FIG. 5, each of the clips 16 is a molded plastic article having a body portion 30, which may be of undulating contour to render it more flexible or resilient.

At opposite ends of the body are integral hooks 32 and 34 adapted to engage an outer edge portion of a plate and the elastic band 16, respectively, as illustrated in FIG. 4.

Thus, it will be appreciated that the invention provides a relatively inexpensive device for holding a decorative article, so that it can be mounted on a wall. The device basically comprises a pair of similiar molded plastic similar bracket members which are drawn together with a continuous elastic band.

What is claimed is:

1. A device for supporting and displaying a decorative article, such as a plate, against a vertical wall surface, comprising:

(a) a pair of generally similar upper and lower unitary brackets spaced from and free from direct contact with each other, said brackets being formed of molded plastic material and each including:

(i) a relatively thin, flat base;

(ii) a pair of integral, laterally spaced arms projecting from one side of said base adjacent an outboard edge thereof and having at the ends thereof curved portions forming hooks for engaging a rim edge portion of a plate;

(iii) a pair of integral, laterally spaced, band hooks located inwardly of said arms and projecting from said one side of said base for engaging portions of an elastic band;

(iv) a nail receiving opening extending therethrough intermediate said band engaging hook;

(v) an integral ledge projecting from said one side of said base adjacent said opening for engaging another portion of said elastic band;

(b) an uninterrupted, elastic band disposed to extend around the band hooks and ledge of each bracket to draw said brackets together and maintain them in a snug engagement with said plate.

* * * * *